US011505843B2

(12) United States Patent
Park et al.

(10) Patent No.: US 11,505,843 B2
(45) Date of Patent: Nov. 22, 2022

(54) ANNEALING SEPARATOR FOR ORIENTED ELECTRICAL STEEL SHEET, ORIENTED ELECTRICAL STEEL SHEET, AND MANUFACTURING METHOD OF ORIENTED ELECTRICAL STEEL SHEET

(71) Applicant: POSCO, Pohang-Si (KR)

(72) Inventors: Chang Soo Park, Pohang-si (KR); Jong Ho Park, Pohang-si (KR); Byung Deug Hong, Pohang-si (KR); Yun Su Kim, Pohang-si (KR)

(73) Assignee: POSCO, Pohang-si (KR)

( * ) Notice: Subject to any disclaimer, the term of this patent is extended or adjusted under 35 U.S.C. 154(b) by 460 days.

(21) Appl. No.: 16/063,483

(22) PCT Filed: Dec. 15, 2016

(86) PCT No.: PCT/KR2016/014743

§ 371 (c)(1),
(2) Date: Jun. 18, 2018

(87) PCT Pub. No.: WO2017/105112

PCT Pub. Date: Jun. 22, 2017

(65) Prior Publication Data

US 2018/0371576 A1 Dec. 27, 2018

(30) Foreign Application Priority Data

Dec. 18, 2015 (KR) ..... 10-2015-0182243

(51) Int. Cl.
*C21D 8/12* (2006.01)
*C22C 38/02* (2006.01)
(Continued)

(52) U.S. Cl.
CPC ..... *C21D 9/46* (2013.01); *C21D 1/06* (2013.01); *C21D 1/68* (2013.01); *C21D 3/04* (2013.01);
(Continued)

(58) Field of Classification Search
None
See application file for complete search history.

(56) References Cited

U.S. PATENT DOCUMENTS 3,522,108 A * 7/1970 Kaneo ..... C03C 4/00 148/245
3,627,594 A 12/1971 Yamamoto et al.
(Continued)

FOREIGN PATENT DOCUMENTS

CN 104726671 A 6/2015
EP 0 164 828 A2 12/1985
(Continued)

OTHER PUBLICATIONS

KR 10-1991-0006010 machine translation (Year: 1991).*
(Continued)

*Primary Examiner* — Paul A Wartalowicz
*Assistant Examiner* — Stephani Hill
(74) *Attorney, Agent, or Firm* — Morgan, Lewis & Bockius LLP

(57) ABSTRACT

An annealing separator for an oriented electrical steel sheet includes: a first component including a Mg oxide or a Mg hydroxide; and a second component including one kind among oxides and hydroxides of a metal selected from Al, Ti, Cu, Cr, Ni, Ca, Zn, Na, K, Mo, In, Sb, Ba, Bi, and Mn, or two or more kinds thereof.

5 Claims, 2 Drawing Sheets

(51) Int. Cl.

| | |
|---|---|
| ***C21D 1/72*** | (2006.01) |
| ***C21D 9/46*** | (2006.01) |
| ***C21D 1/68*** | (2006.01) |
| ***C21D 1/06*** | (2006.01) |
| ***C21D 3/04*** | (2006.01) |
| ***C21D 6/00*** | (2006.01) |
| ***C22C 38/00*** | (2006.01) |
| ***C22C 38/04*** | (2006.01) |
| ***C22C 38/06*** | (2006.01) |
| ***C23C 8/26*** | (2006.01) |
| ***C23C 8/80*** | (2006.01) |

(52) U.S. Cl.

CPC ..... *C21D 6/008* (2013.01); *C21D 8/1222* (2013.01); *C21D 8/1233* (2013.01); *C21D 8/1255* (2013.01); *C21D 8/1261* (2013.01); *C21D 8/1283* (2013.01); *C21D 8/1288* (2013.01); *C22C 38/001* (2013.01); *C22C 38/008* (2013.01); *C22C 38/02* (2013.01); *C22C 38/04* (2013.01); *C22C 38/06* (2013.01); *C23C 8/26* (2013.01); *C23C 8/80* (2013.01); *C21D 1/72* (2013.01)

(56) References Cited

U.S. PATENT DOCUMENTS

| | | | | |
|---|---|---|---|---|
| 3,765,957 | A * | 10/1973 | Hamachi | C23C 24/00 148/307 |
| 3,868,280 | A | 2/1975 | Yamamoto et al. | |
| 3,956,029 | A | 5/1976 | Yamamoto et al. | |
| 4,582,547 | A | 4/1986 | Price | |
| 4,698,272 | A * | 10/1987 | Inokuti | C23C 14/02 428/627 |
| 5,565,272 | A * | 10/1996 | Masui | C21D 8/1283 428/432 |
| 5,718,775 | A | 2/1998 | Komatsubara et al. | |
| 2014/0246124 | A1 | 9/2014 | Okubo et al. | |
| 2018/0030559 | A1* | 2/2018 | Uesaka | C21D 3/04 |

FOREIGN PATENT DOCUMENTS

| | | | | |
|---|---|---|---|---|
| EP | 2 765 219 | A1 | 8/2014 | |
| EP | 3 257 960 | A1 | 12/2017 | |
| GB | 1 279 334 | A | 6/1972 | |
| GB | 1 563 853 | A | 4/1980 | |
| JP | S50-11912 | A | 2/1975 | |
| JP | S51-12450 | A | 4/1976 | |
| JP | S51-12451 | A | 4/1976 | |
| JP | S53-4714 | A | 1/1978 | |
| JP | H02-125883 | A | 5/1990 | |
| JP | H05-295441 | A | 9/1993 | |
| JP | H06-33138 | A | 2/1994 | |
| JP | H09-143637 | A | 6/1997 | |
| JP | H10-088244 | A | 4/1998 | |
| JP | 2000-73120 | A | 3/2000 | |
| JP | 2001-295062 | A | 10/2001 | |
| JP | 2003-268452 | A | 9/2003 | |
| JP | 2014-201806 | A | 10/2014 | |
| KR | 1991-0006010 | B1 | 8/1991 | |
| KR | 10-0297046 | B1 | 10/2001 | |
| KR | 2003-0044033 | A | 6/2003 | |
| KR | 10-0711470 | B1 | 4/2007 | |
| WO | 2008/047999 | A1 | 4/2008 | |
| WO | 2013/051270 | A1 | 4/2013 | |
| WO | WO-2016129291 | A1 * | 8/2016 | C21D 8/1272 |

OTHER PUBLICATIONS

Office Action issued in Japanese Application No. 2018-532111 dated Jul. 16, 2019, with English translation.

Office Action issued in Chinese Patent Application No. 201680074327.0 dated Feb. 22, 2019, with English translation.

International Search Report issued in Application No. PCT/KR2016/014743 dated Mar. 9, 2017, with English translation.

Extended European Search Report issued in European Application No. 16876054.4 dated Oct. 25, 2018.

* cited by examiner

ANNEALING SEPARATOR FOR ORIENTED ELECTRICAL STEEL SHEET, ORIENTED ELECTRICAL STEEL SHEET, AND MANUFACTURING METHOD OF ORIENTED ELECTRICAL STEEL SHEET

RELATED APPLICATIONS

This application is a national stage of International Application No. PCT/KR20161014743, filed Dec. 15, 2016; which claims the benefit of Korean Application No 10-2015-0182243 filed on Dec. 18, 2015, the disclosures of which are incorporated in their entirety by reference herein.

TECHNICAL FIELD

An annealing separator for an oriented electrical steel sheet, an oriented electrical steel sheet, and a manufacturing method of an oriented electrical steel sheet are provided.

BACKGROUND ART

An oriented electrical steel sheet has a texture in which an orientation of grains is in a {110}<001> direction by containing 3.1% of a Si component, and is an electrical steel sheet having an excellent magnetic characteristic in a rolling direction.

Recently, while an oriented electrical steel sheet with a high magnetic flux density is commercially available, a material having small iron loss has been requested. As a method for reducing the iron loss, the following four technical methods are known. i) A first method of accurately orienting a {110}<001> grain direction of a magnetic easy axis of an oriented electrical steel sheet in a rolling direction, ii) a method of reducing an eddy current loss by adding a resistive additive element, iii) a method of minutely forming a magnetic domain through a chemical and physical method, and iv) a method of enhancing a surface property or imparting surface tension by a chemical method such as surface processing.

The iv) method is a method of improving magnetism of the material by positively improving the properties of the oriented electrical steel sheet surface. As a representative example, a method of forming an insulating film having a high tension characteristic on the surface of the electrical steel sheet has been researched.

It is usual for the insulating film to be formed on a forsterite ($Mg_2SiO_4$) series film that becomes a primary film of the steel sheet. This is a technology for producing the reduction effect of the iron loss by applying a tensile stress to the steel sheet by using a thermal expansion coefficient difference of an insulating film and a steel sheet that are formed on the primary film.

Thus, the method for improving the tension characteristic of the film has focused on improving the characteristics of the insulating film. However, the primary film may also provide the tensile stress due to a low thermal expansion characteristic to the steel sheet. Therefore, this may effectively act on an electrical power loss of an iron core or improvement of self-deformation. In other words, since there is a thermal expansion coefficient difference between the steel sheet and the primary film, it is possible to apply the tensile stress characteristic.

Accordingly, if the tension characteristic can be increased by decreasing the thermal expansion coefficient of the primary film, the iron loss reduction effect of the steel sheet may be expected.

DISCLOSURE

Technical Problem

The present invention provides an annealing separator for an oriented electrical steel sheet to form the primary film with an improved tension characteristic, an oriented electrical steel sheet with reduced iron loss by including the same, and a manufacturing method of the oriented electrical steel sheet.

Technical Solution

An example of the present invention provides an annealing separator for an oriented electrical steel sheet includes: a first component including a Mg oxide or a Mg hydroxide; and a second component including one kind among an oxide and a hydroxide of a metal selected from Al, Ti, Cu, Cr, Ni, Ca, Zn, Na, K, Mo, In, Sb, Ba, Bi, and Mn, or two or more kinds thereof, and that satisfies Equation 1 below.

$$0.05<[A]/[B]<10.5 \quad \text{[Equation 1]}$$

(In Equation 1, [A] is a content of the second component with respect to a total amount (100 wt %) of the annealing separator, and [B] is a content of the first component with respect to the total amount (100 wt %) of the annealing separator).

In detail, the second component includes a Mn oxide or a Mn hydroxide.

In more detail, the second component may be $MnO_2$, and the first component may be MgO.

Another example of the present invention provides an oriented electrical steel sheet including: an oriented electrical steel sheet; and a primary film positioned on a surface of the oriented electrical steel sheet, wherein the primary film is made of two or more phases, the primary film includes a first phase including forsterite (Mg2SiO4) and a second phase including one kind among an oxide of a metal selected from Al, Ti, Cu, Cr, Ni, Ca, Zn, Na, K, Mo, In, Sb, Ba, Bi, and Mn, or two or more kinds thereof, and the second phase is more than 3 area % and less than 94 area % with respect to a total area of the primary film.

The two or more phases included in the primary film may have different thermal expansion coefficients from each other.

The oriented electrical steel sheet may satisfy Equation 2 below.

$$[C]\leq[D] \quad \text{[Equation 2]}$$

(In Equation 2, [C] is the content of the metal selected from Al, Ti, Cu, Cr, Ni, Ca, Zn, Na, K, Mo, In, Sb, Ba, Bi, and Mn in the steel sheet before high temperature annealing, and [D] is the content of the metal selected from Al, Ti, Cu, Cr, Ni, Ca, Zn, Na, K, Mo, In, Sb, Ba, Bi, and Mn in the steel sheet except for the primary film after completing high temperature annealing).

The second phase includes one kind, or two or more kinds thereof, among the Mn oxides.

In detail, the second phase may include one kind among MnO, $MnO_2$, $MnO_3$, $Mn_2O_7$, $Mn_2O_3$, $Mn_3O_4$ $MnSiO_3$, $Mn_2SiO_4$, $MnAl_2O_4$, $Mn_2Al_4Si_5O_{12}$, and $Mn_3Al_2Si_3O_{12}$, or two or more kinds thereof.

In detail, the oriented electrical steel sheet may satisfy Equation 3 below.

$$[E]\leq[F] \quad \text{[Equation 3]}$$

(In Equation 3, [E] is the content of Mn in the steel sheet before high temperature annealing, and [F] is the Mn content of the steel sheet except for the primary film after completing high temperature annealing).

Another example of the present invention provides a manufacturing method of an oriented electrical steel sheet, including: a step of preparing a steel slab; a step of heating the steel slab; a step of hot-rolling the heated steel slab to manufacture a hot-rolled sheet; a step of cold-rolling the hot-rolled sheet after annealing the hot-rolled sheet to manufacture a cold-rolled sheet; a step of decarburizing and nitriding-annealing the cold-rolled sheet; a step of coating an annealing separator on the surface of the decarburized and nitriding-annealed steel sheet; a step of high temperature annealing the steel sheet to which the annealing separator is coated to obtain a primary film on the surface of the steel sheet; and a step of obtaining an oriented electrical steel sheet, wherein the annealing separator includes: a first component including a Mg oxide or a Mg hydroxide; and a second component including one kind among an oxide and a hydroxide of a metal selected from Al, Ti, Cu, Cr, Ni, Ca, Zn, Na, K, Mo, In, Sb, Ba, Bi, and Mn, or two or more kinds thereof, and that satisfies Equation 1 below.

$$0.05<[A]/[B]<10.5 \quad \text{[Equation 1]}$$

(In Equation 1, [A] is a content of the second component with respect to a total amount (100 wt %) of the annealing separator, and [B] is a content of the first component with respect to the total amount (100 wt %) of the annealing separator).

In the step of the decarburization and nitriding-annealing of the cold-rolled sheet, an oxidation layer including a silicon oxide or an iron oxide is formed on the surface of the decarburized and nitriding-annealed steel sheet.

In the step of high temperature annealing the steel sheet to which the annealing separator is coated to obtain the primary film on the surface of the steel sheet, the primary film may be formed by the oxidation layer including the silicon oxide or the iron oxide, the inside steel sheet, or a combination thereof; and the annealing separator.

In detail, the second component of the annealing separator includes one kind, or two or more kinds, of the Mn oxide and hydroxide, In more detail, the second component of the annealing separator may be $MnO_2$, and the first component may be MgO.

the primary film may include one kind among MnO, $MnO_2$, $MnO_3$, $Mn_2O_7$, $Mn_2O_3$, $MnSiO_3$, $Mn_2SiO_4$, $MnAl_2O_4$, $Mn_2Al_4Si_5O_{12}$, $Mn_3Al_2Si_3O_{12}$, or two or more kinds thereof.

An annealing temperature of the step of high temperature annealing the steel sheet to which the annealing separator is coated to obtain the primary film on the surface of the steel sheet may be from 950 to 1250° C.

The step of high temperature annealing the steel sheet to which the annealing separator is coated to obtain the primary film on the surface of the steel sheet may include a step of increasing a temperature at an average of 50° C./h to 650° C. for the steel sheet coated with the annealing separator and a step of increasing a temperature at an average of 15° C./h from 650° C. to the annealing temperature in a mixed gas atmosphere of hydrogen and nitrogen.

The step of decarburizing and nitriding-annealing the cold-rolled sheet may be performed at 800 to 950° C.

The steel slab may include 2.0 to 4.0 wt % of silicon (Si), 0.01 to 0.20 wt % of chromium (Cr), 0.02 to 0.04 wt % of aluminum (Al), 0.01 to 0.20 wt % of manganese (Mn), 0.04 to 0.07 wt % of carbon (C), 0.001 to 0.005 wt % of sulfur (S), 0.001 to 0.01 wt % of nitrogen (N), and Fe and other inevitable impurities as the remainder.

The examples of the present invention provide the annealing separator for the oriented electrical steel sheet for forming the primary film with the improved tension characteristic, the oriented electrical steel sheet manufactured by using the same and with the reduced iron loss, and the manufacturing method of the oriented electrical steel sheet using the annealing separator for the oriented electrical steel sheet.

Advantageous Effects

MODE FOR INVENTION

Figure 1:
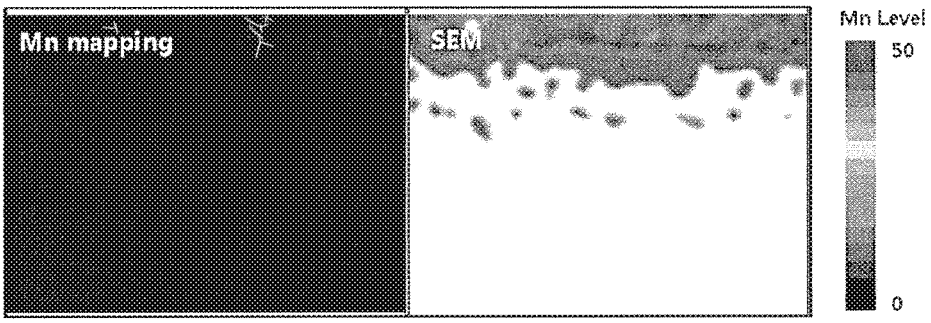
FIG. 1 is a view showing a distribution of a Mn element in a primary film of an oriented electrical steel sheet obtained by a usual method using EPMA equipment.

Hereinafter, exemplary embodiments of the present invention will be described in detail. The exemplary embodiments, however, are provided as examples, and the present invention is not limited thereto, but is defined within the range of claims to be described below.

The terms first, second, third, and the like are used to describe various portions, components, regions, layers, and/or sections, but the present invention is not limited thereto. These terms are used only to distinguish any portion, component, region, layer, or section from other portions, components, regions, layers, or sections. Therefore, a first portion, component, region, layer, or section to be described below may be referred to as a second portion, component, region, layer, or section without departing from the scope of the present invention.

The technical terms used herein are used merely for the purpose of describing a specific exemplary embodiment, and are not intended to limit the present invention. Singular expressions used herein include plural expressions unless they have expressly opposite meanings. The terms "comprises" and/or "comprising" used in the specification specify particular features, regions, integers, steps, operations, elements, components, but do not preclude the presence or addition of other features, regions, integers, steps, operations, elements, and/or components thereof.

It will be understood that when an element such as a layer, film, region, or substrate is referred to as being "on" another element, it can be directly on the other element or intervening elements may also be present. In contrast, when an element is referred to as being "directly on" another element, there are no intervening elements present.

If not defined differently, all the terminologies including the technical terminologies and scientific terminologies used herein have meanings that are the same as ones that those skilled in the art generally use. Terms defined in dictionaries should be construed as having meanings corresponding to the related prior art documents and those stated herein, and are not to be construed as being ideal or official, if not so defined.

Also, unless otherwise specified, "A to B" means A or more and B or less.

An Annealing Separator for an Oriented Electrical Steel Sheet

An example of the present invention provides an annealing separator for an oriented electrical steel sheet that includes: a first component including a Mg oxide or a Mg hydroxide; and a second component including one kind among an oxide and a hydroxide of a metal selected from Al, Ti, Cu, Cr, Ni, Ca, Zn, Na, K, Mo, In, Sb, Ba, Bi, and Mn, or two or more kinds of these, and that satisfies Equation 1 below.

$$0.05<[A]/[B]<10.5 \quad \text{[Equation 1]}$$

(In Equation 1, [A] is a content of the second component with respect to a total amount (100 wt %) of the annealing separator, and [B] is a content of the first component with respect to the total amount (100 wt %) of the annealing separator).

Generally, when manufacturing an oriented electrical steel sheet, in a decarburization and nitriding-annealing step, silicon (Si) of a component having a highest oxygen affinity in the steel sheet is reacted with oxygen such that $SiO_2$ is formed on the surface of the steel sheet. Also, in the annealing process, if oxygen gradually penetrates into the steel sheet, an iron (Fe)-based oxide ($Fe_2SiO_4$, etc.) is further formed. In other words, in the decarburization and nitriding-annealing process, an oxidation layer including $SiO_2$ and the iron (Fe)-based oxide is inevitably formed on the surface of the steel sheet.

After this decarburization and nitriding-annealing process, the annealing separator including a magnesium oxide or a magnesium hydroxide is coated on the surface of the steel sheet surface and then a high temperature annealing process is performed, and in this case, $SiO_2$ in the oxidation layer is reacted with the magnesium oxide or the magnesium hydroxide. This reaction may be represented by Chemical Reaction Formula 1 or Chemical Reaction Formula 2 below, and this corresponds to the reaction forming forsterite ($Mg_2SiO_4$), that is, the primary film. The forsterite layer produced by the Mg oxide or the Mg hydroxide helps to stably generate secondary recrystallization in a high temperature annealing process.

$$2Mg(OH)2+SiO2 \rightarrow Mg2SiO4+2H2O \quad \text{[Chemical Reaction Formula 1]}$$

$$2MgO+SiO2 \rightarrow Mg2SiO4+2H2O \quad \text{[Chemical Reaction Formula 2]}$$

On the surface of the oriented electrical steel sheet, except for special cases, it is common to form a primary film mainly composed of the forsterite. The primary film typically prevents coalescence between the steel sheets that are spiral-wound in a coil and provides the tension due to thermal expansion difference with the steel sheet, thereby there are effects of decreasing the iron loss and providing insulation.

In addition to this, it is possible to improve the magnetic properties by converting the characteristics of the primary film formed on the surface of the oriented electrical steel sheet. Specifically, in addition to the above-mentioned forsterite, a new phase including other elements such as Al, Ti, Cu, Cr, Ni, Ca, Zn, Na, K, Mo, In, Sb, Ba, Bi, Mn, and the like as a main component is also produced in the primary film. Since these produced phases have different thermal expansion characteristics, the effects of the contraction and the expansion locally differ in the primary film. Accordingly, the tension effect of the primary film may be maximized, thereby obtaining the low iron loss of the steel sheet.

Specifically, it may be confirmed that the second component may contain the Mn oxide or the Mn hydroxide. Particularly, the Mn oxide may not only stably participate in the primary film formation reaction, but also the additional magnetic improvement effect may be expected as well as the characteristic improvement of the primary film. For example, the Mn oxide may be MnO, $MnO_2$, $Mn_2O_3$, or $Mn_3O_4$, and the Mn hydroxide may be $Mn(OH)_4$, $MnSO_4$ $(H_2O)$, or $MnSO_4$ $(H_2O)_5$. However, it is not limited thereto.

In detail, the second component may be $MnO_2$, and the first component may be MgO.

The primary film formed on the surface of the steel sheet from the annealing separator in which the Mn oxide or hydroxide is mixed along with the Mg oxide or hydroxide additionally includes other phases as well as the forsterite phase. They are produced as the Mn oxide or hydroxide of the annealing separator as the main Mn oxide is reacted with $SiO_2$ of the oxidation layer, the Fe oxide, or the components inside the steel sheet formed during the decarburization and nitriding-annealing process. As a detailed example, the Mn oxide produced in the primary film may be MnO, $MnO_2$, $MnO_3$, $Mn_2O_7$, $Mn_2O_3$, $MnSiO_3$, $Mn_2SiO_4$, $MnAl_2O_4$, $Mn_2Al_4Si_5O_{12}$, $Mn_3Al_2Si_3O_{12}$, etc.

The MnO, $MnO_2$, $MnO_3$, $Mn_2O_7$, or $Mn_2O_3$ may be produced as the Mn oxide or hydroxide of the annealing separator is reacted with oxygen during the annealing process, and $MnSiO_3$ or $Mn_2SiO_4$ may be produced as the Mn oxide or hydroxide of the annealing separator is reacted with $SiO_2$ of the oxidation layer formed during the decarburization and nitriding-annealing process. $MnAl_2O_4$, $Mn_2Al_4Si_5O_{12}$, or $Mn_3Al_2Si_3O_{12}$ may be produced as the Mn oxide or hydroxide of the annealing separator is reacted with $SiO_2$ of the oxidation layer and Al inside the steel sheet during the decarburization and nitriding-annealing process. For example, a part of the Mn oxide may be produced through Chemical Reaction Formula 3.

$$2MnO_2+SiO_2 \rightarrow Mn_2SiO_4+O_2 \quad \text{[Chemical Reaction Formula 3]}$$

The Mn oxides produced on the primary film have different thermal expansion coefficients from the forsterite phase ($Mg_2SiO_4$), and accordingly, the compression-expansion effect in the primary film is different. As a result, the tension effect of the primary film may be maximized, and accordingly, the iron loss of the steel sheet may be reduced.

Equation 1 may be $0.05<[A]/[B]<10.5$ for the annealing separator. When a ratio [A]/[B] of two compositions is less than 0.05, the Mn oxide is not produced inside the primary film, and as the ratio is very small, it may be difficult to obtain the improvement effect of the film tension characteristic. When the ratio [A]/[B] of two compositions is more than 10.5, a precipitate such as MnS is excessively produced in the steel sheet surface, or the production speed is slow in the primary film such that secondary recrystallization growth is disturbed, and accordingly it is disadvantageous in obtaining the magnetic characteristic of the oriented electrical steel sheet. In detail, Equation 1 may be $0.1 \leq [A]/[B] \leq 9.5$, and this is supported by examples below and comparative examples in comparison thereto.

When using the annealing separator including the Mn oxide or the Mn hydroxide, in addition to the primary film's phase change, an additional property occurs in the steel sheet.

In detail, in the high temperature annealing process, the part of the Mn oxide or the Mn hydroxide included in the annealing separator is diffused and penetrates the steel such that the content of Mn of the steel sheet is increased.

Generally, Mn is known as an element that increases specific resistance of the iron, along with Si, Al, etc. Accordingly, if the Mn content in the steel increases, the specific resistance of the oriented electrical steel sheet finally obtained is increased such that the effect of the reduction of the iron loss appears.

However, an increase of the Mn content of the steel sheet may be obtained by changing an Mn input amount in a steelmaking process, however in this case, the property of the steel is changed such that the following processes such as hot rolling-cold rolling decarburization, nitriding-annealing, etc. are required.

In contrast, when using the annealing separator including the Mn oxide or hydroxide, since the Mn content of the steel sheet in an almost final step among the entire process for obtaining the oriented electrical steel sheet increases, it is unnecessary to consider the change of the following process like the case of changing the steelmaking component.

Resultantly, the present invention simultaneously has the effects of the tension increasing of the primary film through the use of the local thermal expansion difference and the specific resistance increasing through the Mn content increasing of the steel sheet, thereby the oriented electrical steel sheet with low iron loss may be obtained even without the conventional process.

The Oriented Electrical Steel Sheet

Another example of the present invention includes the oriented electrical steel sheet, and the primary film positioned on the surface of the oriented electrical steel sheet, wherein the primary film is made of two or more phases, the primary film includes the first phase including the forsterite ($Mg_2SiO_4$) and the second phase including one kind among the oxides of the metals selected from Al, Ti, Cu, Cr, Ni, Ca, Zn, Na, K, Mo, In, Sb, Ba, Bi, and Mn or two or more kinds thereof, and the second phase exceeds 3 area % and less than 94 area % for total area (100 area %) of the primary film.

As the primary film of the oriented electrical steel sheet includes two or more phases having the different thermal expansion coefficients from each other, the effect of the local compression-expansion in the primary film is differentiated. Accordingly, the tension effect of the primary film may be maximized, thereby obtaining low iron loss of the steel sheet.

The primary film formed from the annealing separator provided from one example of the present invention includes the second phase including one kind among the oxides of the metals selected from Al, Ti, Cu, Cr, Ni, Ca, Zn, Na, K, Mo, In, Sb, Ba, Bi, and Mn inside the film, or two or more kinds thereof.

The second phase may be included to exceed 3 area % and less than 94 area % for the total area (100 area %) of the primary film. When the area of the second phase is 3% or less, the amount is too small to obtain the local compression-expansion effect such that the tension improvement effect may not appear. When the area of the second phase is 94% or more, the ratio occupied with other phases in the primary film is small such that the tension improvement effect may not appear. In detail, the second phase may be included at 10 area % or more and 94 area % or less for the total area (100 area %) of the primary film. This is supported by examples below and comparative examples in comparison thereto.

When manufacturing the oriented electrical steel sheet, the part of the oxide or the hydroxide of the metal selected from Al, Ti, Cu, Cr, Ni, Ca, Zn, Na, K, Mo, In, Sb, Ba, Bi, and Mn included in the annealing separator is diffused and penetrates the steel in the high temperature annealing process such that the content of Al, Ti, Cu, Cr, Ni, Ca, Zn, Na, K, Mo, In, Sb, Ba, Bi, or Mn of the steel sheet increases. These metals may play a role of increasing the specific resistance. Accordingly, as the content of these metals in the steel increases, the specific resistance of the finally obtained oriented electrical steel sheet increases, thereby the effect of low iron loss appears. In detail, the oriented electrical steel sheet may be an oriented electrical steel sheet satisfying Equation 2 below.

$$[C] \leq [D] \quad \text{[Equation 2]}$$

(In Equation 2, [C] is the content of the metal selected from Al, Ti, Cu, Cr, Ni, Ca, Zn, Na, K, Mo, In, Sb, Ba, Bi, and Mn in the steel sheet before high temperature annealing, and [D] is the content of the metal selected from Al, Ti, Cu, Cr, Ni, Ca, Zn, Na, K, Mo, In, Sb, Ba, Bi, and Mn in the steel sheet except for the primary film after the completion of high temperature annealing)

The second phase may include one kind, or two or more kinds thereof, among the Mn oxides. In detail, the second phase may include one kind among MnO, $MnO_2$, $MnO_3$, $Mn_2O_7$, $Mn_2O_3$, $Mn_3O_4$ $MnSiO_3$, $Mn_2SiO_4$, $MnAl_2O_4$, $Mn_2Al_4Si_5O_{12}$, and $Mn_3Al_2Si_3O_{12}$, or two or more kinds thereof.

When manufacturing the oriented electrical steel sheet, the part of the Mn oxide or the Mn hydroxide included in the annealing separator is diffused and penetrates in the high temperature annealing process such that the Mn content of the steel sheet increases. Generally, Mn is known as an element that increases the specific resistance of the iron along with Si, Al, etc. Accordingly, if the Mn content in the steel increases, the specific resistance of the oriented electrical steel sheet finally obtained is increased such that the effect of the reduction of the iron loss appears. In detail, the oriented electrical steel sheet may be an oriented electrical steel sheet satisfying Equation 3 below.

$$[E] \leq [F] \quad \text{[Equation 3]}$$

(In Equation 3, [E] is the content of Mn in the steel sheet before high temperature annealing, and [F] is the Mn content of the steel sheet except for the primary film after the completion of high temperature annealing).

A Manufacturing Method of the Oriented Electrical Steel Sheet

Another example of the present invention provides a manufacturing method of the oriented electrical steel sheet including: a step of preparing a steel slab; a step of heating the steel slab; a step of hot-rolling the heated steel slab to manufacture a hot-rolled sheet; a step of cold-rolling the hot-rolled sheet after a hot-rolled sheet is annealed to manufacture a cold-rolled sheet; a step of decarburizing and nitriding-annealing the cold-rolled sheet; a step of coating an annealing separator on the surface of the decarburized and nitriding-annealed steel sheet; a step of high temperature annealing the steel sheet coated with the annealing separator to form the primary film on the surface of the steel sheet; and a step of obtaining the oriented electrical steel sheet, wherein the annealing separator includes a first component including the Mg oxide or the Mg hydroxide, and a second component including one kind among the oxide and the hydroxide of the metal selected from Al, Ti, Cu, Cr, Ni, Ca, Zn, Na, K, Mo, In, Sb, Ba, Bi, and Mn, or two or more kinds thereof, and satisfies Equation 1 below.

$$0.05 < [A]/[B] < 10.5 \quad \text{[Equation 1]}$$

(In Equation 1, [A] is a content of the second component with respect to a total amount (100 wt %) of the annealing separator, and [B] is the content of the first component with respect to the total amount (100 wt %) of the annealing separator).

Generally, when manufacturing the oriented electrical steel sheet, in a decarburization and nitriding-annealing step, silicon (Si) as a component having a highest oxygen affinity in the steel sheet is reacted with oxygen such that $SiO_2$ is formed on the surface of the steel sheet. Also, in the annealing process, if oxygen is gradually penetrated into the steel sheet, an iron (Fe)-based oxide ($Fe_2SiO_4$, etc.) is further formed. In other words, in the decarburization and nitriding-annealing process, an oxidation layer including $SiO_2$ and the iron (Fe)-based oxide is inevitably formed on the surface of the steel sheet.

After this decarburization and nitriding-annealing process, the annealing separator including a magnesium oxide or a magnesium hydroxide is coated on the surface of the steel sheet surface and then a high temperature annealing process is performed, and in this case, $SiO_2$ in the oxidation layer is reacted with the magnesium oxide or the magnesium hydroxide. This reaction may be represented by Chemical Reaction Formula 1 or Chemical Reaction Formula 2 below, and this corresponds to the reaction forming forsterite ($Mg_2SiO_4$), that is, the primary film. The forsterite layer produced by the Mg oxide or the Mg hydroxide helps to stably generate secondary recrystallization in a high temperature annealing process.

$$2Mg(OH)_2+SiO_2 \rightarrow Mg_2SiO_4\ (\text{forsterite})+2H_2O \quad \text{[Chemical Reaction Formula 1]}$$

$$2MgO+SiO_2 \rightarrow Mg_2SiO_4\ (\text{forsterite})+2H_2O \quad \text{[Chemical Reaction Formula 2]}$$

On the surface of the oriented electrical steel sheet, except for special cases, it is common to form a primary film mainly composed of the forsterite. The primary film typically prevents coalescence between the steel sheets that are spiral-wound with a coil shape and provides the tension due to thermal expansion difference with the steel sheet, thereby there are effects of decreasing the iron loss and providing the insulation.

In addition to this, it is possible to improve the magnetic properties by changing the characteristics of the primary film formed on the surface of the oriented electrical steel sheet. Specifically, in addition to the above-mentioned forsterite, a new phase including other elements such as Al, Ti, Cu, Cr, Ni, Ca, Zn, Na, K, Mo, In, Sb, Ba, Bi, Mn, and the like as a main component is also produced in the primary film. Since these produced phases have different thermal expansion characteristics, the effects of the contraction and the expansion locally differ in the primary film. Accordingly, the tension effect of the primary film may be maximized, thereby obtaining the low iron loss of the steel sheet.

Specifically, it may be confirmed that the second component may contain the Mn oxide or the Mn hydroxide. Particularly, the Mn oxide may not only stably participate in the primary film formation reaction, but the additional magnetic improvement effect may also be expected in addition to the characteristic improvement of the primary film. For example, the Mn oxide may be MnO, $MnO_2$, $Mn_2O_3$, or $Mn_3O_4$, and the Mn hydroxide may be $Mn(OH)_4$, $MnSO_4(H_2O)$, or $MnSO_4(H_2O)_5$. However, it is not limited thereto.

In detail, the second component may be $MnO_2$, and the first component may be MgO.

The primary film formed on the surface of the steel sheet from the annealing separator in which the Mn oxide or hydroxide is mixed along with the Mg oxide or hydroxide additionally includes other phases as well as the forsterite phase. They are produced as the Mn oxide or hydroxide of the annealing separator as the main Mn oxide is reacted with $SiO_2$ of the oxidation layer, the Fe oxide, or the components inside the steel sheet formed during the decarburization and nitriding-annealing process. As a detailed example, the Mn oxide produced in the primary film may be MnO, $MnO_2$, $MnO_3$, $Mn_2O_7$, $Mn_2O_3$, $MnSiO_3$, $Mn_2SiO_4$, $MnAl_2O_4$, $Mn_2Al_4Si_3O_{12}$, $Mn_3Al_2Si_3O_{12}$, etc.

The MnO, $MnO_2$, $MnO_3$, $Mn_2O_7$, and $Mn_2O_3$ may be produced as the Mn oxide or hydroxide of the annealing separator is reacted with oxygen during the annealing process, and $MnSiO_3$ of $Mn_2SiO_4$ may be produced as the Mn oxide or hydroxide of the annealing separator is reacted with $SiO_2$ of the oxidation layer formed during the decarburization and nitriding-annealing process. $MnAl_2O_4$, $Mn_2Al_4Si_3O_{12}$, and $Mn_3Al_2Si_3O_{12}$ may be produced as the Mn oxide or hydroxide of the annealing separator is reacted with $SiO_2$ of the oxidation layer and Al inside the steel sheet during the decarburization and nitriding-annealing process. For example, a part of the Mn oxide may be produced by Chemical Reaction Formula 3.

$$2MnO_2+SiO_2 \rightarrow Mn_2SiO_4+O_2 \quad \text{[Chemical Reaction Formula 3]}$$

The Mn oxides produced on the primary film have the different thermal expansion coefficients from the forsterite phase ($Mg_2SiO_4$), and accordingly, the compression-expansion effect in the primary film is differentiated. As a result, the tension effect of the primary film may be maximized, and accordingly, the iron loss of the steel sheet may be reduced.

In the manufacturing method of the oriented electrical steel sheet, Equation 1 may be $0.05<[A]/[B]<10.5$. When a ratio [A]/[B] of two compositions is less than 0.05, the Mn oxide is not produced inside the primary film, and the ratio is very small such that it may be difficult to obtain the improvement effect of the film tension characteristic. When a ratio [A]/[B] of two compositions is more than 10.5, a precipitate such as MnS is excessively produced in the steel sheet surface, or the production speed is slow in the primary film such that a secondary recrystallization growth is disturbed, and accordingly it is disadvantageous in obtaining the magnetic characteristic of the oriented electrical steel sheet. In detail, Equation 1 may be $0.1\leq[A]/[B]\leq9.5$. This is supported by examples below and comparative examples in comparison thereto.

When using the annealing separator including the Mn oxide or the Mn hydroxide, in addition to the primary film's phase change, an additional property occurs in the steel sheet.

In detail, in the high temperature annealing process, the part of the Mn oxide or the Mn hydroxide included in the annealing separator is diffused and penetrates into the steel such that the content of Mn of the steel sheet is increased.

Generally, Mn is known as an element that increases specific resistance of the iron along with Si, Al, etc. Accordingly, if the Mn content increases in the steel, the specific resistance of the oriented electrical steel sheet finally obtained is increased such that the effect of the reduction of the iron loss appears.

However, a general increase of the Mn content of the steel sheet may be obtained by changing an Mn input amount in a steelmaking process, however in this case, the property of the steel is changed such that the following processes such as hot rolling-cold rolling decarburization, nitriding-annealing, etc. are required.

In contrast, when using the annealing separator including the Mn oxide or hydroxide, since the Mn content of the steel sheet in an almost final step among the entire process for obtaining the oriented electrical steel sheet increases, it is unnecessary to consider the change of the following process like the case of changing the steelmaking components.

Resultantly, the present invention simultaneously has the effects of the tension increase of the primary film through the use of the local thermal expansion difference and the specific resistance increase through the Mn content increase of the steel sheet, thereby the oriented electrical steel sheet with low iron loss may be obtained even without the conventional process.

In the manufacturing method of the oriented electrical steel sheet, the step of the decarburization and nitriding-annealing of the cold-rolled sheet may be performed at a temperature from 800 to 950° C. When the temperature of the decarburization and nitriding-annealing is too low, in addition to not performing the decarburization and the nitriding well, the crystal grains are maintained in a fine state such that the crystal may be grown in an undesirable direction during high temperature annealing. When the temperature of the decarburization and nitriding-annealing is too high, a problem that the primary recrystallized crystal grains are excessively grown may be generated.

The annealing temperature of the step of obtaining the primary film on the steel sheet surface by annealing the steel sheet coated with the annealing separator at a high temperature may be from 950° C. to 1250° C. When the high temperature annealing temperature is too low, the primary film and the secondary recrystallization may not be formed. When the high temperature annealing temperature is too high, a productivity reduction and durability of a high temperature annealing equipment may be affected.

The step of obtaining the primary film on the steel sheet surface by annealing the steel sheet coated with the annealing separator at a high temperature may include a step of increasing the temperature of the steel sheet coated with the annealing separator to 650° C. at an average of 50° C./h, and a step of increasing the temperature at an average of 15° C./h from 650° C. to the annealing temperature, in a mixed gas atmosphere of hydrogen and nitrogen.

The step of obtaining the primary film on the steel sheet surface by annealing the steel sheet coated with the annealing separator at a high temperature may be performed for 18 to 22 hours.

The steel slab may include 2.0 to 4.0 wt % of silicon (Si), 0.01 to 0.20 wt % of chromium (Cr), 0.02 to 0.04 wt % of aluminum (Al), 0.01 to 0.20 wt % of manganese (Mn), 0.04 to 0.07 wt % of carbon (C), 0.001 to 0.005 wt % of sulfur (S), 0.001 to 0.01 wt % of nitrogen (N), and Fe and other inevitable impurities as the remainder.

Hereinafter, examples of the present invention and comparative examples will be described in detail. However, the following examples are for exemplary purposes only, and the scope of the present invention is not limited thereto.

Example—Manufacturing of the Oriented Electrical Steel Sheet

The steel slab including of C at 0.05%, Si at 3.2%, Mn at 0.01%, Sn at 0.05%, Al at 0.03%, N at 0.004%, as weight percentages, and Fe and other inevitable impurities as the remainder, is prepared.

Next, the steel slab is heated to a temperature of 1200° C. and then is hot-rolled to manufacture the hot-rolled sheet with a 2.6 mm thickness.

Next, after the hot-rolled sheet is soaked at a temperature of 900° C. for 180 seconds, the hot-rolled sheet is annealed and cooled, is acid-pickled, and then is cold-rolled to manufacture the cold-rolled sheet with a 0.30 mm thickness.

Next, the cold-rolled sheet is decarburized and nitriding-annealed in a mixed gas atmosphere of hydrogen, nitrogen, and ammonia, at a temperature of 840° C. and the dew point of 58° C.

Next, the manganese oxide ($MnO_2$) and the magnesium oxide (MgO) are coated on the surface of the annealed steel sheet while variously changing a weight ratio thereof as shown in Table 1, and then are dried at a temperature of 600° C. for 12 seconds.

In the annealing separator ratio [A]/[B] of Table 1, [A] is the content of the manganese oxide ($MnO_2$) for the total amount (100 wt %) of the annealing separator, and [B] is the content of the magnesium oxide (MgO) for the total amount (100 wt %) of the annealing separator.

Next, for the steel sheet in which the annealing separator is coated and dried, after the temperature increases at an average of 50° C./h to 650° C. and the temperature increases at an average of 15° C./h in the mixed gas atmosphere of 50:50 as the weight ratio of hydrogen:nitrogen from 650° C. to 1200° C., and the same temperature is maintained for 20 hours after reaching 1200° C., it is cooled.

The finally obtained oriented electrical steel sheet is then surface-cleaned to manufacture the oriented electrical steel sheet in which the primary film is formed.

Experimental Examples

The tension effect and the magnetic characteristic depending on the ratio of the second phase except for the forsterite in the primary film of the oriented electrical steel sheet are confirmed.

Experimental Example 1

For the oriented electrical steel sheet of the example, the existence of the Mn oxide (the second phase) in the primary film is confirmed, and the area ratio of the Mn oxide (the second phase) in the primary film is measured. In Table 1, the area ratio of the second phase for the primary film means the area % of the Mn oxide (the second phase) in the primary film with respect to the total area (100 area %) of the primary film.

The existence of the Mn oxide in the primary film may be confirmed by using an Electro Probe Micro-Analyzer (EPMA). The measuring method of the EPMA is a method of quantitatively and qualitatively measuring the distribution of the element in the film and the steel sheet, and FIG. 1 shows a result of analyzing the primary film of the general oriented electrical steel sheet, while FIG. 2 shows a result of analyzing the primary film of the oriented electrical steel sheet obtained through an exemplary embodiment of the present invention.

Figure 2:
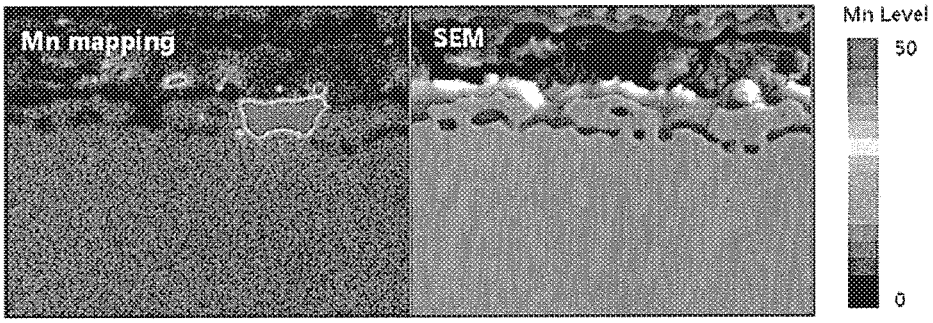
FIG. 2 is a view showing a distribution of a Mn element in a primary film of an oriented electrical steel sheet obtained through an exemplary embodiment of the present invention using EPMA equipment.

The distribution of the Mn element in the primary film is not confirmed in FIG. 1, however it may be confirmed that the region where the Mn element is distributed clearly appears in FIG. 2. That is, in the case of an exemplary embodiment of the present invention, it is confirmed that the Mn oxide exists in the primary film.

An area ratio of the Mn oxide (the second phase) in the primary film is measured by using EPMA equipment.

Experimental Example 2

An abnormal eddy current loss and iron loss of the oriented electrical steel sheet of the example are measured. The iron loss is estimated under a 50 Hz condition at 1.7 T by using a single sheet measuring method, and the abnormal eddy current loss is measured by using the above-described iron loss separation method with a single sheet tester.

Table 1 shows a measuring result of the abnormal eddy current loss and the iron loss.

Experimental Example 3

The Mn content of the steel sheet before and after the high temperature annealing and the specific resistance value of the steel sheet after the high temperature annealing are measured. The Mn content of the steel sheet before and after the high temperature annealing is measured by using an Inductively Coupled Plasma-Atomic Emission Spectrometer (ICP-AES) after removing the primary film. The specific resistance value of the steel sheet after the high temperature annealing is measured by using 4 point probes after removing the primary film of a 300×60 cm high temperature annealing specimen.

The measuring results are shown in Table 2.

TABLE 1

| | Annealing separator ratio ([A]/[B]) | Area ratio of a second phase in a primary film (%) | Abnormal eddy current loss W/kg) | Iron loss (W17/50) |
|---|---|---|---|---|
| Comparative Example 1 | 0.05 | 3 | 0.512 | 0.99 |
| Example 1 | 0.1 | 10 | 0.469 | 0.95 |
| Example 2 | 1.2 | 14 | 0.465 | 0.96 |
| Example 3 | 3.8 | 22 | 0.453 | 0.94 |
| Example 4 | 5.9 | 47 | 0.427 | 0.91 |
| Example 5 | 8.4 | 72 | 0.438 | 0.93 |
| Example 6 | 9.5 | 89 | 0.467 | 0.93 |
| Comparative Example 2 | 10.5 | 94 | 0.515 | 1.01 |
| Comparative Example 3 | 12.3 | 97 | 0.521 | 1.05 |

TABLE 2

| | Before high temperature annealing Mn content (ppm) | After high temperature annealing Mn content (ppm) | Specific resistance (μΩ · cm) |
|---|---|---|---|
| Comparative Example 1 | 980 | 979 | 48.72 |
| Example 1 | 980 | 1250 | 48.79 |
| Example 2 | 980 | 1800 | 49.10 |
| Example 3 | 980 | 1950 | 49.43 |
| Example 4 | 980 | 2130 | 49.55 |
| Example 5 | 980 | 2800 | 49.98 |
| Example 6 | 980 | 3010 | 50.64 |
| Comparative Example 2 | 980 | 3000 | 50.64 |
| Comparative Example 3 | 980 | 2760 | 50.38 |

According to Table 1, it may be confirmed that the ratio of the second phase in the primary film produced after the high temperature annealing and the values of the abnormal eddy current loss and the iron loss are differentiated depending on the weight ratio ([A]/[B]) of $MnO_2$ and MgO of the annealing separator. That is, when the weight ratio [A]/[B] of the annealing separator is less than 0.1 or more than 10, high values of the abnormal eddy current loss and the iron loss are measured compared with the case of from 0.1 to 10.

Also, when the ratio of the Mn oxide (the second phase) in the primary film is less than 10% and more than 90%, it may be confirmed that the magnetic characteristic is inferior compared with the case of 10% to 90%. Accordingly, when the ratio of the Mn oxide (the second phase) produced in the primary film is less than 10% or more than 90%, a thermal expansion difference effect of the phases configuring the primary film clearly appears.

This fact may be further confirmed through the measurement values of the abnormal eddy current loss of Table 1. The abnormal eddy current loss measured by the iron loss separation method decreases as the tension effect of the primary film increases, and the values of the abnormal eddy current loss of Examples 1 to 6 are small compared with Comparative Examples 1 to 3. Accordingly, it may be confirmed that the tension characteristic of the primary film produced in Examples 1 to 6 is excellent.

Also, as the content of the $MnO_2$ included in the annealing separator increases, the Mn content of the steel sheet after the high temperature annealing increases, and accordingly it may be confirmed that the specific resistance increases together therewith. (Table 2) As the specific resistance increases, since the iron loss is improved, the improvement result of the iron loss in the example is considered to also be complicatedly affected by the increase effect of the specific resistance according to the increase of the Mn content as well as the tension effect of the primary film.

However, in the case of Comparative Examples 2 and 3, even if the specific resistance increases, the iron loss increases, and this is because the tension effect of the primary film not only deteriorates compared with the exemplary embodiments, but also a large amount of precipitates such as MnS is produced in the steel sheet surface while the content of $MnO_2$ increases in the annealing separator such that the secondary recrystallization is not normally generated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An oriented electrical steel sheet comprising:

an oriented electrical steel sheet; and a primary film positioned on a surface of the oriented electrical steel sheet, wherein the primary film is made of two or more phases, the primary film includes a first phase including forsterite ($Mg_2SiO_4$) and a second phase including one kind or two or more kinds among Mn oxides and the second phase is more than 47 area % and less than 72 area % with respect to a total area of the primary film.

2. The oriented electrical steel sheet of claim 1, wherein two or more phases included in the primary film have different thermal expansion coefficients from each other.

3. The oriented electrical steel sheet of claim 1, wherein the oriented electrical steel sheet satisfies Equation 2 below:

$$[C] \leq [D] \quad \text{[Equation 2]}$$

wherein [C] is a content of a metal selected from Al, Ti, Cu, Cr, Ni, Ca, Zn, Na, K, Mo, In, Sb, Ba, Bi, and Mn in the steel sheet before annealing at a temperature from 950° C. to 1250° C., and [D] is a content of a metal selected from Al, Ti, Cu, Cr, Ni, Ca, Zn, Na, K, Mo, In, Sb, Ba, Bi, and Mn in the steel sheet except for the primary film after completing high temperature annealing at 950° C. to 1250° C.

4. The oriented electrical steel sheet of claim 1, wherein the second phase includes one kind among MnO, $MnO_2$, $MnO_3$, $Mn_2O_7$, $Mn_2O_3$, $Mn_3O_4$ $MnSiO_3$, $Mn_2SiO_4$, $MnAl_2O_4$, $Mn_2Al_4Si_5O_{12}$, and $Mn_3Al_2Si_3O_{12}$, or two or more kinds thereof.

5. The oriented electrical steel sheet of claim 4, wherein the oriented electrical steel sheet satisfies Equation 3 below:

$$[E] \leq [F] \quad \text{[Equation 3]}$$

wherein [E] is a content of Mn in the steel sheet before annealing at a temperature from 950° C. to 1250° C., and [F] is a Mn content of the steel sheet except for the primary film after completing high temperature annealing at 950° C. to 1250° C.

* * * * *